US010900664B2

(12) United States Patent
Tsuei et al.

(10) Patent No.: US 10,900,664 B2
(45) Date of Patent: Jan. 26, 2021

(54) FUEL GAS NOZZLE

(71) Applicant: National Chung-Shan Institute of Science and Technology, Taoyuan (TW)

(72) Inventors: Yung-Mao Tsuei, Nantou County (TW); Chih-Chuan Lee, Taichung (TW); Chi-Fang Chiu, Taichung (TW)

(73) Assignee: National Chung-Shan Institute of Science and Technology, Taoyuan (TW)

( * ) Notice: Subject to any disclaimer, the term of this patent is extended or adjusted under 35 U.S.C. 154(b) by 129 days.

(21) Appl. No.: 16/228,768

(22) Filed: Dec. 21, 2018

(65) Prior Publication Data

US 2020/0200391 A1 Jun. 25, 2020

(51) Int. Cl.

| | |
|---|---|
| ***F23R 3/28*** | (2006.01) |
| ***F23R 3/12*** | (2006.01) |
| ***F23R 3/14*** | (2006.01) |
| ***F23R 3/26*** | (2006.01) |
| ***F23N 1/02*** | (2006.01) |
| ***F23K 5/00*** | (2006.01) |

(52) U.S. Cl.

CPC ..... *F23R 3/286* (2013.01); *F23K 5/007* (2013.01); *F23N 1/027* (2013.01); *F23R 3/12* (2013.01); *F23R 3/14* (2013.01); *F23R 3/26* (2013.01); *F23N 2235/16* (2020.01); *F23N 2235/26* (2020.01); *F23N 2239/04* (2020.01)

(58) Field of Classification Search

CPC .... F23R 3/04; F23R 3/045; F23R 3/12; F23R 3/14; F23R 3/34; F23R 3/346; F23R 3/36; F23R 3/286; F23R 3/26

See application file for complete search history.

(56) References Cited

U.S. PATENT DOCUMENTS 2,669,090 A * 2/1954 Jackson ..... F02C 3/34 60/606
2,930,194 A * 3/1960 Perkins ..... F23R 3/045 60/748

(Continued)

OTHER PUBLICATIONS

Nozzle Analysis: Variations in Mach Number and Pressure Along a Converging and a Converging-diverging Nozzle. JoVE, Cambridge, MA, (2020). <https://www.jove.com/science-education/10466/nozzle-analysis-variations-mach-number-pressure-along-converging> (Year: 2020).*

*Primary Examiner* — Todd E Manahan
*Assistant Examiner* — Thuyhang N Nguyen
(74) *Attorney, Agent, or Firm* — Winston Hsu

(57) ABSTRACT

A fuel gas nozzle used in a microturbine includes a first chamber, a second chamber connected to the first chamber, a pilot fuel gas pipe, a main fuel gas pipe and an intake pipe. An intake zone and a mixing zone are respectively formed in the first chamber and the second chamber and are communicated with each other. The pilot fuel gas pipe is for introducing a first fuel gas into a downstream of the second chamber. The main fuel gas pipe is for introducing a second fuel gas into the mixing zone via the intake zone. The intake pipe is for introducing an air into the mixing zone. A centerline of the intake pipe is not intersected with a centerline of the second chamber, so as to induce a vortex flow field of the air flowing into the mixing zone for mixing the air and the second fuel gas.

10 Claims, 4 Drawing Sheets

(56) References Cited

U.S. PATENT DOCUMENTS

| | | | | |
|---|---|---|---|---|
| 8,161,751 | B2 * | 4/2012 | Hall | F23D 11/103 60/742 |
| 9,347,663 | B2 * | 5/2016 | Poyyapakkam | F23R 3/14 |
| 2015/0322857 | A1 * | 11/2015 | Ethier | F02C 7/04 290/2 |
| 2018/0363906 | A1 * | 12/2018 | Bailey | F23R 3/286 |

* cited by examiner

FUEL GAS NOZZLE

BACKGROUND OF THE INVENTION

1. Field of the Invention

The present invention refers to a fuel gas nozzle used in a microturbine, in more detail, to a fuel gas nozzle used in a microturbine with an enhanced mixing effect of air and fuel gas.

2. Description of the Prior Art

A fuel gas nozzle is one of the accessory devices used in a microturbine and capable of introducing a mixture of air and fuel gas into a combustion chamber of the microturbine. A conventional fuel gas nozzle usually includes a mixing chamber, a plurality of intake openings arranged along a circumferential direction of the mixing chamber and a plurality of guiding plates located at the mixing chamber and adjacent to the corresponding plurality of intake openings. The intake openings introduce the air from surrounding environment into the mixing chamber, and guiding plates induce a vortex flow field of the air flowing into the mixing chamber to mix the air and the fuel gas. A flame size in the combustion chamber of the microturbine depends on homogeneity in mixing of the air and the fuel gas, that is, when the homogeneity in mixing of the air and the fuel gas is better, the flame in the combustion chamber of the microturbine is smaller. However, the conventional flow design usually drives the air to flow along a single direction, i.e., a longitudinal direction of the mircoturbine, toward the fuel gas nozzle when the fuel gas nozzle is installed on the microturbine, so that the air hardly flows into the mixing chamber through the intake openings and the guiding plates located at a leeward side, which increases difficulty of controlling a flow rate of the air and brings a negative effect on inducing the vortex flow field of the air flowing into the mixing chamber, which reduces the homogeneity in mixing of the air and the fuel gas. Furthermore, the fuel gas may be easily blown out from the mixing chamber through the intake openings by the air. Besides, a size of the combustion chamber is determined by a length of the flame to prevent burnout of a liner of the combustion chamber. Therefore, a size of the mircoturbine cannot be reduced effectively due to the poor homogeneity in mixing of the air and the fuel gas.

Furthermore, different types of fuel gas require different air-fuel ratios because of different compositions and different heating values. However, when the air flows into the mixing chamber via the openings, the flow rate of the air cannot be adjusted according to different types of fuel gas, such as methane, propane, biogas and wood gas, due to a fixed size of the opening of the mixing chamber.

Therefore, there is a need to provide an improved fuel gas nozzle.

SUMMARY OF THE INVENTION

Therefore, it is an objective of the present invention to provide a fuel gas nozzle used in a microturbine with an enhanced mixing effect of air and fuel gas for solving the aforementioned problems.

In order to achieve the aforementioned objective, the present invention discloses a fuel gas nozzle used in a microturbine. The fuel gas nozzle includes a first chamber, a second chamber, a pilot fuel gas pipe, a main fuel gas pipe and an intake pipe. An intake zone is formed in the first chamber. The second chamber is connected to the first chamber. A mixing zone is formed in the second chamber and communicated with the intake zone. The pilot fuel gas pipe is disposed on a top surface of the first chamber and penetrates through the intake zone and the mixing zone for introducing a first fuel gas into a downstream of the second chamber. The main fuel gas pipe is disposed on a lateral surface of the first chamber and communicated with the intake zone for introducing a second fuel gas into the mixing zone via the intake zone. The intake pipe is disposed on a lateral surface of the second chamber. The intake pipe has an inlet end and an outlet end opposite to each other and communicated with the mixing zone for introducing an air into the mixing zone. A centerline of the intake pipe is not intersected with a centerline of the second chamber, so as to induce a vortex flow field of the air flowing into the mixing zone for mixing the air and the second fuel gas.

According to an embodiment of the present invention, the fuel gas nozzle further includes a distributor disposed between the intake zone and the mixing zone for allowing the second fuel gas to flow from the intake zone to the mixing zone through the distributor.

According to an embodiment of the present invention, the distributor includes a plurality of inclined blades to induce a vortex flow field of the second fuel gas flowing into the mixing zone opposite to the vortex flow field of the air flowing into the mixing zone.

According to an embodiment of the present invention, the distributor comprises a plate component with a plurality of apertures for allowing the second fuel gas to flow from the intake zone to the mixing zone.

According to an embodiment of the present invention, the fuel gas nozzle further includes a flow control value disposed on the intake pipe and near the inlet end of the intake pipe for controlling a flow rate of the air flowing into the mixing zone.

According to an embodiment of the present invention, the flow control valve includes a passage communicated with the inlet end and the outlet end of the intake pipe. The flow control valve controls an opening area of the passage for controlling a ratio of the air to the second fuel gas.

According to an embodiment of the present invention, the second fuel gas is methane, propane, biogas or wood gas.

According to an embodiment of the present invention, a sectional area of the inlet end is greater than a sectional area of the outlet end.

According to an embodiment of the present invention, a sectional area of intake pipe gradually decreases from the inlet end to the outlet end.

According to an embodiment of the present invention, the intake pipe is formed in a horn shape.

According to an embodiment of the present invention, an inclined angle of a wall of the intake pipe relative to the centerline of the intake pipe is substantially from 10 to 30 degrees.

According to an embodiment of the present invention, the sectional area of the inlet end is substantially twelve times as large as the sectional area of the outlet end.

In summary, the present invention utilizes the intake pipe whose centerline is not intersected with the centerline of the second chamber to induce the vortex flow field of the air flowing into the mixing zone for mixing the air and the second fuel gas, so that the air and the second fuel gas can be completely mixed due to the vortex flow field of the air. Besides, the present invention further utilizes the distributor with the plurality of inclined blades for inducing the vortex flow field of the second fuel gas flowing into the mixing zone opposite to the vortex flow field of the air flowing into the mixing zone, so that the air and the second fuel gas can be completely mixed in a short time period due to the vortex flow field of the air and the vortex flow field of the second fuel gas. Since the air and the second fuel gas are completely mixed before being injected into a combustion chamber, a length of a flame inside the combustion chamber can be reduced effectively, so that a size of the combustion chamber can be also reduced accordingly. Furthermore, the air flows through the intake pipe into mixing zone along a single direction, and there is no other opening formed on the second chamber. Therefore, it prevents the second fuel gas inside the mixing zone from being blown out. Moreover, the present invention can adjust an air-fuel ratio, i.e, a ratio of the air to the second fuel gas, by controlling the flow rate of the air, according to different types of fuel gas, such as methane, propane, biogas and wood gas, with the flow control valve to achieve better combustion efficiency. Therefore, the fuel gas nozzle of the present invention is suitable for different microturbines in different applications, which facilitates promotion of green energy.

These and other objectives of the present invention will no doubt become obvious to those of ordinary skill in the art after reading the following detailed description of the preferred embodiment that is illustrated in the various figures and drawings.

DETAILED DESCRIPTION

In the following detailed description of the preferred embodiments, reference is made to the accompanying drawings which form a part hereof, and in which is shown by way of illustration, specific embodiments in which the invention may be practiced. In this regard, directional terminology, such as "top," "bottom," "front," "back," etc., is used with reference to the orientation of the Figure (s) being described. The components of the present invention can be positioned in a number of different orientations. As such, the directional terminology is used for purposes of illustration and is in no way limiting. Accordingly, the drawings and descriptions will be regarded as illustrative in nature and not as restrictive.

Figure 1:
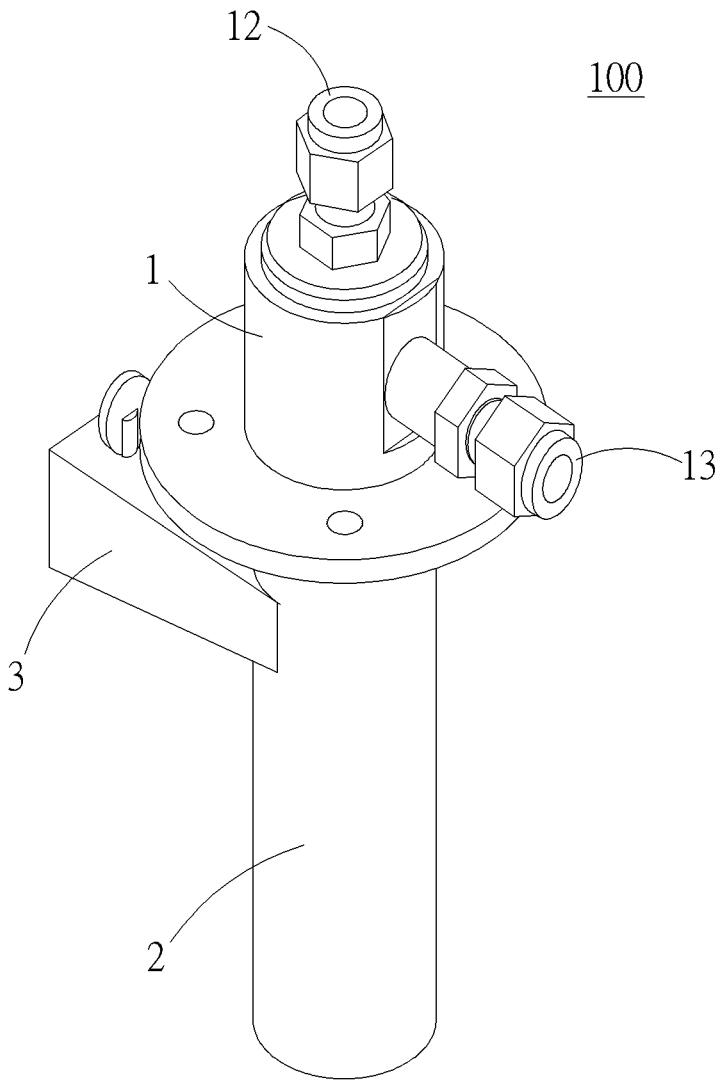
FIG. 1 is a schematic diagram of a fuel gas nozzle according to a first embodiment of the present invention.
Figure 2:
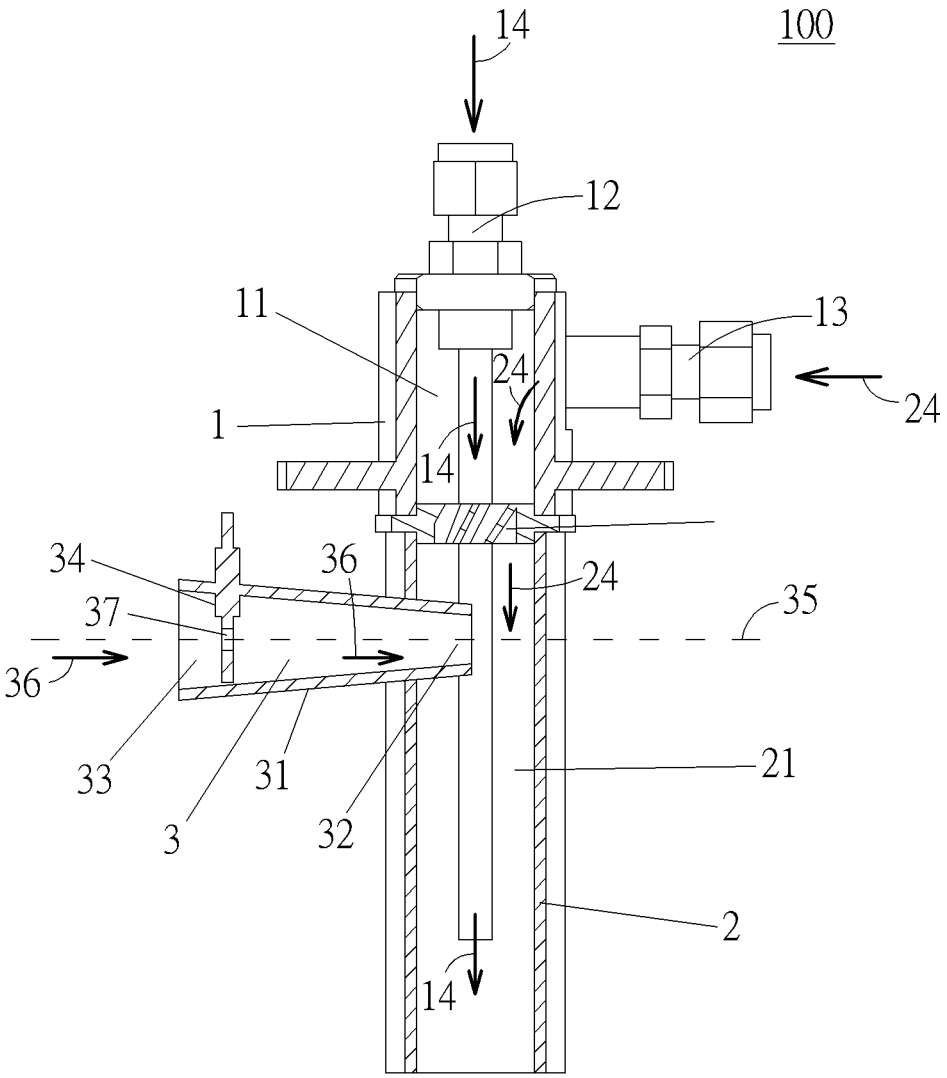
FIG. 2 is a sectional diagram of the fuel gas nozzle according to the first embodiment of the present invention.
Figure 3:
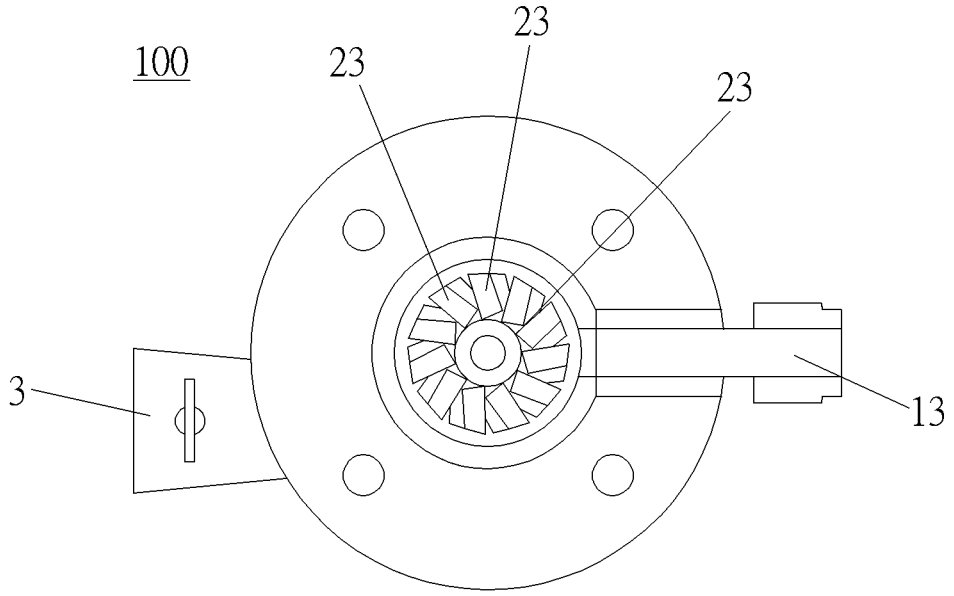
FIG. 3 is another sectional diagram of the fuel gas nozzle according to the first embodiment of the present invention.
Figure 4:
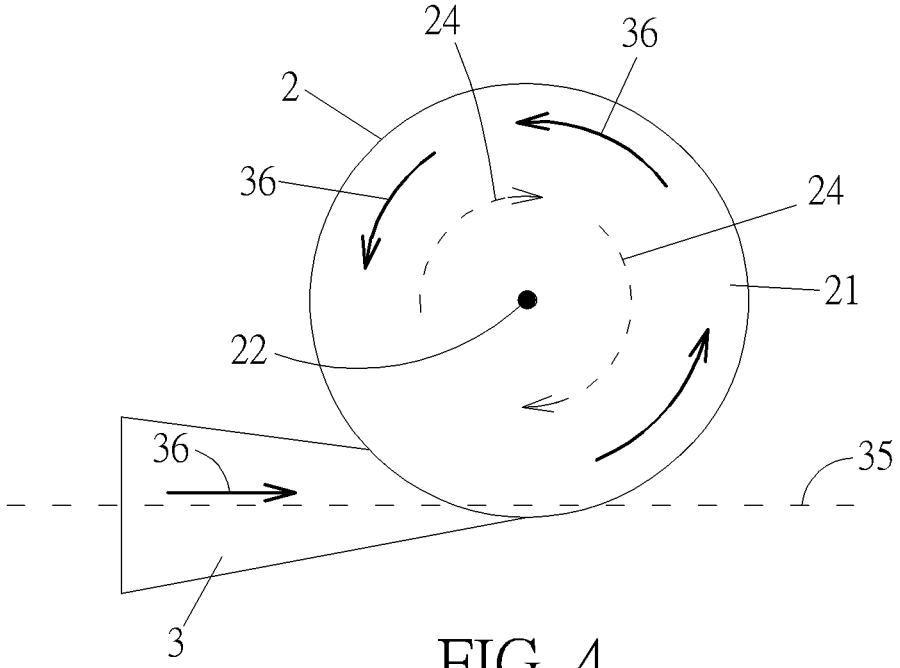
FIG. 4 is a diagram illustrating a vortex flow field of an air and a vortex flow field of a second fuel gas in a mixing zone according to the first embodiment.

Please refer to FIG. 1 to FIG. 4. FIG. 1 is a schematic diagram of a fuel gas nozzle 100 according to a first embodiment of the present invention. FIG. 2 is a sectional diagram of the fuel gas nozzle 100 according to the first embodiment of the present invention. FIG. 3 is another sectional diagram of the fuel gas nozzle 100 according to the first embodiment of the present invention. FIG. 4 is a diagram illustrating a vortex flow field of an air 36 and a vortex flow field of a second fuel gas 24 in a mixing zone 21 according to the first embodiment. As shown in FIG. 1 to FIG. 3, the fuel gas nozzle 100 is installed on a microturbine for introducing fuel gas into a combustion chamber of the microturbine, which is not shown in figures. The fuel gas nozzle 100 includes a first chamber 1, a second chamber 2, a distributor 23, a pilot fuel gas pipe 12, a main fuel gas pipe 13 and an intake pipe 3. The second chamber 2 is connected to the first chamber 1 and communicated with the first chamber 1 and the combustion chamber of the microturbine. In this embodiment, the first chamber 1 and the second chamber 2 can be two hollow cylinders. An intake zone 11 is formed in the first chamber 1. The mixing zone 21 is formed in the second chamber 2 and communicated with the intake zone 11. The pilot fuel gas pipe 12 is disposed on a top surface of the first chamber 1 and penetrates through the intake zone 11 and the mixing zone 21 for introducing a first fuel gas 14 into a downstream of the second chamber 2. Furthermore, the main fuel gas pipe 13 is disposed on a lateral surface of the first chamber 1 and communicated with the intake zone 11 for introducing the second fuel gas 24 into the intake zone 11, and the distributor 23 is disposed between the intake zone 11 and the mixing zone 22, so that the second fuel gas 24 is allowed to flow from the intake zone 11 into the mixing zone 21 through the distributor 23. The intake pipe 3 is disposed on a lateral surface of the second chamber 2 for introducing the air 36 from the environment into the mixing zone 21. That is, the first fuel gas 14 can be configured to flow into the combustion chamber directly, and the second fuel gas 24 can be configured to be mixed with the air in the mixing zone 21 before flowing into the combustion chamber. However, it is not limited to this embodiment. The distributor 23 also can be omitted in another embodiment.

Specifically, as shown in FIG. 2 to FIG. 4, the intake pipe 3 has an inlet end 33 and an outlet end 32 opposite to the inlet end 33 and communicated with the mixing zone 21 for introducing the air 36 into the mixing zone 21. A centerline 35 of the intake pipe 3 is not intersected with a centerline 22 of the second chamber 2, that is the intake pipe 3 is eccentric with respect to the second chamber 2, so as to induce a vortex flow field of the air 36 flowing into the mixing zone 21 for mixing the air 36 and the second fuel gas 24 by a cyclone effect. The distributor 23 includes a plurality of inclined blades 231 to induce a vortex flow field of the second fuel gas 24 flowing into the mixing zone 21 opposite to the vortex flow field of the air 36 flowing into the mixing zone 21. For example, in this embodiment, the vortex flow field of the second fuel gas 24 can flow in a clockwise direction, and the vortex flow field of the air 36 can flow in counter clockwise direction. Since the vortex flow field of the second fuel gas 24 and the vortex flow field of the air 36 are opposite to each other, the second fuel gas 24 and the air 36 can be mixed completely in a short time period.

Furthermore, the fuel gas nozzle 100 further includes a flow control value 34 disposed on the intake pipe 3 and near the inlet end 33 of the intake pipe 3 for controlling a flow rate of the air 36 flowing into the mixing zone 21. The flow control valve 34 includes a passage 37 communicated with the inlet end 33 and the outlet end 32 of the intake pipe 3, so that the flow control valve 34 can adjust the flow rate of the air 36 by controlling an opening area of the passage 37 to control a ratio of the second fuel gas 24 to the air 36. The second fuel gas 24 can be methane, propane, biogas or wood gas (mainly CO and $H_2$) according to practical demands, and the ratio of the air 36 to the second fuel gas 24 can be adjusted to 9.52 (the ratio of the air to the methane), 23.8

(the ratio of the air to the propane), 5.71 (the ratio of the air to the biogas), or 0.89 (the ratio of the air to the wood gas) by operating the flow control value 34. Therefore, it is not required to redesign a size of the inlet end 33.

Preferably, in order to facilitate adjustment of the ratio of the air 36 to the second fuel gas 24, a sectional area of the inlet end 33 can be greater than a sectional area of the outlet end 32. More preferably, the sectional area of the inlet end 33 can be substantially twelve times as large as the sectional area of the outlet end 32. Furthermore, reasonably, a sectional area of intake pipe 3 can gradually decrease from the inlet end 33 to the outlet end 32 and formed in a horn shape, so as to enlarge the inlet end 33. An inclined angle of a wall 31 of the intake pipe 3 relative to the centerline 35 of the intake pipe 3 can be substantially from 10 to 30 degrees.

Figure 5:
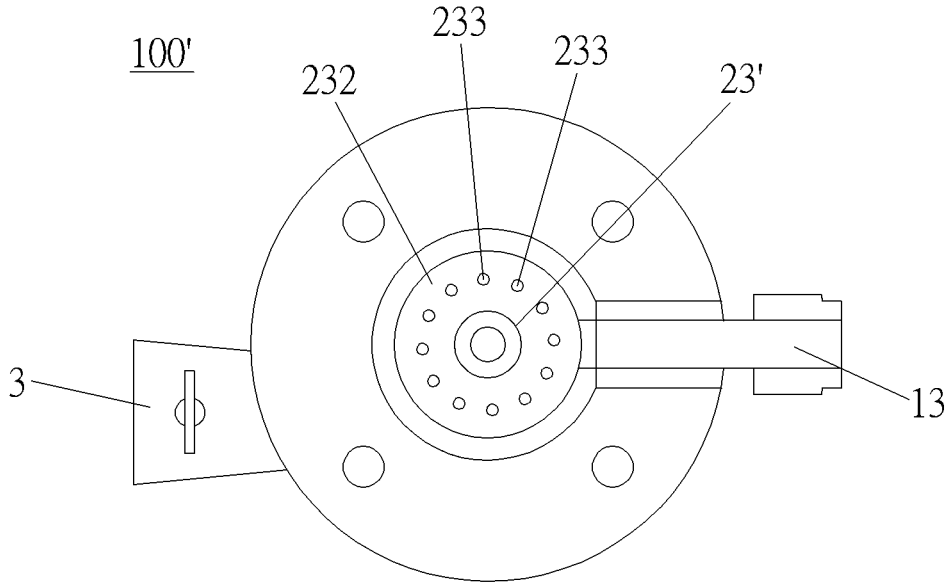
FIG. 5 is a sectional diagram of a fuel gas nozzle according to a second embodiment of the present invention.
Figure 6:
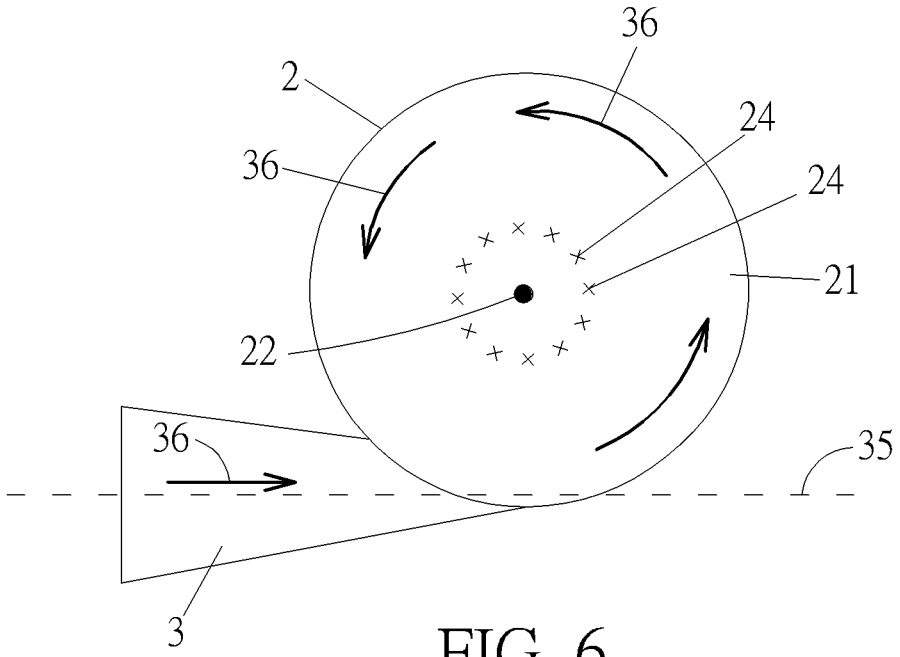
FIG. 6 is a diagram illustrating a vortex flow field of an air and a vortex flow field of a second fuel gas in a mixing zone according to the second embodiment.

Please further refer to FIG. 5 and FIG. 6. FIG. 5 is a sectional diagram of a fuel gas nozzle 100' according to a second embodiment of the present invention. FIG. 6 is a diagram illustrating a vortex flow field of the air 36 and a vortex flow field of the second fuel gas 24 in the mixing zone 21 according to the second embodiment. As shown in FIG. 5 and FIG. 6, different from the fuel gas nozzle 100 of the first embodiment, the fuel gas nozzle 100' includes a distributor 23' different from the distributor 23 of the first embodiment. The distributor 23' includes a plate component 232 with a plurality of apertures 233. In other words, in this embodiment, the distributor 23' can allow the second fuel gas 24 to flow from the intake zone 11 to the mixing zone 21 uniformly instead of inducing the vortex flow field of the second fuel gas 24 as mentioned in the first embodiment, and there is only the vortex flow field of the air 36 in the clockwise direction in the mixing zone 21. However, the second fuel gas 24 and the air 36 still can be mixed completely by the vortex flow field of the air 36.

In contrast to the prior art, the present invention utilizes the intake pipe whose centerline is not intersected with the centerline of the second chamber to induce the vortex flow field of the air flowing into the mixing zone for mixing the air and the second fuel gas, so that the air and the second fuel gas can be completely mixed due to the vortex flow field of the air. Besides, the present invention further utilizes the distributor with the plurality of inclined blades for inducing the vortex flow field of the second fuel gas flowing into the mixing zone opposite to the vortex flow field of the air flowing into the mixing zone, so that the air and the second fuel gas can be completely mixed in a short time period due to the vortex flow field of the air and the vortex flow field of the second fuel gas. Since the air and the second fuel gas are completely mixed before being injected into the combustion chamber, a length of a flame inside the combustion chamber can be reduced effectively, so that a size of the combustion chamber can be also reduced accordingly. Furthermore, the air flows through the intake pipe into mixing zone along a single direction, and there is no other opening formed on the second chamber. Therefore, it prevents the second fuel gas inside the mixing zone from being blown out. Moreover, the present invention can adjust an air-fuel ratio, i.e, a flow ratio of the air to the second fuel gas, by controlling the flow rate of the air, according to different types of fuel gas, such as methane, propane, biogas and wood gas, with the flow control valve to achieve better combustion efficiency. Therefore, the fuel gas nozzle of the present invention is suitable for different microturbines in different applications, which facilitates promotion of green energy.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A fuel gas nozzle used in a microturbine, the fuel gas nozzle comprising:

a first chamber, an intake zone being formed in the first chamber;

a second chamber connected to the first chamber, a mixing zone being formed in the second chamber and communicated with the intake zone;

a pilot fuel gas pipe disposed on a top surface of the first chamber and penetrating through the intake zone and the mixing zone for introducing a first fuel gas into a downstream of the second chamber;

a main fuel gas pipe disposed on a lateral surface of the first chamber and communicated with the intake zone for introducing a second fuel gas into the mixing zone via the intake zone; and an intake pipe disposed on a lateral surface of the second chamber, the intake pipe having an inlet end and an outlet end opposite to each other and communicated with the mixing zone for introducing an air into the mixing zone;

a distributor disposed between the intake zone and the mixing zone for allowing the second fuel gas to flow from outside of the distributor to the intake zone to the mixing zone through the distributor;

wherein a centerline of the intake pipe is not intersected with a centerline of the second chamber, so as to induce a vortex flow field of the air flowing into the mixing zone for mixing the air and the second fuel gas, and the distributor induces a vortex flow field of the second fuel gas flowing into the mixing zone opposite to the vortex flow field of the air flowing into the mixing zone.

2. The fuel gas nozzle of claim 1, wherein the distributor comprises a plurality of inclined blades to induce the vortex flow field of the second fuel gas flowing into the mixing zone opposite to the vortex flow field of the air flowing into the mixing zone.

3. The fuel gas nozzle of claim 1, further comprising a flow control valve disposed on the intake pipe and near the inlet end of the intake pipe for controlling a flow rate of the air flowing into the mixing zone.

4. The fuel gas nozzle of claim 3, wherein the flow control valve comprises a passage communicated with the inlet end and the outlet end of the intake pipe, the flow control valve controls an opening area of the passage for controlling a ratio of the air to the second fuel gas.

5. The fuel gas nozzle of claim 4, the second fuel gas is methane, propane, biogas or wood gas.

6. The fuel gas nozzle of claim 1, wherein a sectional area of the inlet end is greater than a sectional area of the outlet end.

7. The fuel gas nozzle of claim 6, wherein a sectional area of the intake pipe gradually decreases from the inlet end to the outlet end.

8. The fuel gas nozzle of claim 7, wherein the intake pipe is formed in a horn shape.

9. The fuel gas nozzle of claim 6, wherein an inclined angle of a wall of the intake pipe relative to the centerline of the intake pipe is from 10 to 30 degrees.

10. The fuel gas nozzle of claim 6, wherein the sectional area of the inlet end is twelve times as large as a sectional area of the outlet end.

* * * * *